US007931356B2

(12) United States Patent
Lu et al.

(10) Patent No.: US 7,931,356 B2
(45) Date of Patent: Apr. 26, 2011

(54) NOZZLE PLATE

(75) Inventors: Chun-Fu Lu, Hsinchu (TW); Chun-Jung Chen, Yunlin Hsien (TW); Jinn-Cherng Yang, Yilan County (TW); Chi-Ming Huang, Changhua County (TW); Hung-Liang Chiang, Chiayi County (TW)

(73) Assignee: Industrial Technology Research Institute, Hsinchu (TW)

( * ) Notice: Subject to any disclaimer, the term of this patent is extended or adjusted under 35 U.S.C. 154(b) by 233 days.

(21) Appl. No.: 11/308,828

(22) Filed: May 12, 2006

(65) Prior Publication Data

US 2007/0040870 A1 Feb. 22, 2007

(30) Foreign Application Priority Data

Aug. 16, 2005 (TW) ..... 94127837 A

(51) Int. Cl.

| | |
|---|---|
| ***B41J 2/045*** | (2006.01) |
| ***B41J 2/135*** | (2006.01) |
| ***B41J 2/14*** | (2006.01) |
| ***B41J 2/16*** | (2006.01) |

(52) U.S. Cl. ..... 347/68; 347/45; 347/47

(58) Field of Classification Search ..... 347/45, 347/47

See application file for complete search history.

(56) References Cited

U.S. PATENT DOCUMENTS

| | | | | |
|---|---|---|---|---|
| 5,434,606 | A * | 7/1995 | Hindagolla et al. | 347/45 |
| 5,595,785 | A | 1/1997 | Hindagolla et al. | 430/320 |
| 5,598,193 | A | 1/1997 | Halko et al. | 347/45 |
| 5,617,631 | A | 4/1997 | Nguyen | 29/890.1 |
| 5,770,271 | A | 6/1998 | Imamura | 427/412.1 |
| 6,015,210 | A | 1/2000 | Kanematsu et al. | 347/87 |
| 6,102,521 | A | 8/2000 | Halko et al. | 347/47 |
| 6,132,028 | A | 10/2000 | Su et al. | 347/47 |
| 6,151,045 | A | 11/2000 | Beach et al. | 347/45 |
| 6,243,112 | B1 | 6/2001 | Kuhman et al. | 347/45 |
| 6,252,307 | B1 | 6/2001 | Appelt et al. | 257/784 |
| 6,290,331 | B1 * | 9/2001 | Agarwal et al. | 347/47 |
| 6,296,344 | B1 | 10/2001 | Sharma et al. | 347/45 |
| 6,312,103 | B1 | 11/2001 | Haluzak | 347/45 |
| 6,325,490 | B1 | 12/2001 | Yang et al. | 347/45 |
| 6,331,055 | B1 | 12/2001 | Miller et al. | 347/92 |
| 6,336,697 | B1 | 1/2002 | Fukushima | 347/20 |
| 6,341,842 | B1 | 1/2002 | Beach et al. | 347/45 |
| 6,345,881 | B1 | 2/2002 | Yang et al. | 347/45 |
| 6,364,456 | B1 | 4/2002 | Yang et al. | 347/47 |
| 6,364,464 | B1 | 4/2002 | Ahn | 347/61 |
| 6,409,931 | B1 | 6/2002 | Shimomura et al. | 216/27 |

(Continued)

FOREIGN PATENT DOCUMENTS

| | | |
|---|---|---|
| CN | 1314249 | 9/2001 |

(Continued)

*Primary Examiner* — Matthew Luu
*Assistant Examiner* — Lisa M Solomon
(74) *Attorney, Agent, or Firm* — Jianq Chyun IP Office

(57) ABSTRACT

A nozzle plate suited for a droplet generator is provided. The nozzle plate includes a nozzle layer and at least one filler. The nozzle layer has a nozzle and at least one trench. The nozzle passes through the nozzle layer. The trenches apart from the nozzle are formed on a surface of the nozzle layer around the nozzle. The filler is filled in the trench. The wetting angle of the surface of the filler is different from the wetting angle of the surface of the nozzle layer. The nozzle plate has higher surface wear resistance and lower probability of jamming at the nozzle.

28 Claims, 6 Drawing Sheets

U.S. PATENT DOCUMENTS

| | | | | |
|---|---|---|---|---|
| 6,444,275 | B1 | 9/2002 | Kuhman et al. | 427/490 |
| 6,474,566 | B1 * | 11/2002 | Hirota et al. | 239/102.2 |
| 6,478,418 | B2 | 11/2002 | Reboa et al. | 347/100 |
| 6,484,399 | B2 | 11/2002 | Aono et al. | 29/890.1 |
| 6,660,072 | B2 | 12/2003 | Chatterjee | 106/31.58 |
| 2004/0174411 | A1 * | 9/2004 | Sumiya et al. | 347/47 |

FOREIGN PATENT DOCUMENTS

| | | |
|---|---|---|
| TW | 526340 | 4/2003 |

* cited by examiner

NOZZLE PLATE

CROSS-REFERENCE TO RELATED APPLICATION

This application claims the priority benefit of Taiwan application serial no. 94127837, filed on Aug. 16, 2005. All disclosure of the Taiwan application is incorporated herein by reference.

BACKGROUND OF THE INVENTION

1. Field of the Invention

The present invention relates to a nozzle plate. More particularly, the present invention relates to a nozzle plate with higher surface wear resistance and lower probability of jamming at the nozzle.

2. Description of Related Art

Digital jet-printing technology mainly relates to coat a carrier with tiny liquid drops according to a predetermined pattern. The ability of dwindling the liquid drops and control accuracy of a jet-printing position determine the level of printing resolution, and even the yield of a jet-printing element. Further, these qualities are closely related to the structure of the nozzle plate of the inkjet printhead. Therefore, the nozzle plate of a thermal bubble inkjet printhead or a piezoelectrical ink jet printhead has become a non-negligible key point of research and development.

U.S. Pat. No. 6,364,456 discloses a surface coating layer of a nozzle plate of an inkjet printhead, wherein the surface of the nozzle plate is fully coated with an anti-wetting material to form an anti-wetting layer. However, the inner edge of a nozzle near to the nozzle plate on the anti-wetting layer is easily wiped by a wiper used for cleaning and is thereby damaged, causing a deflection in direction of jetting the liquid drops.

U.S. Pat. No. 6,290,331 discloses a high efficiency nozzle plate and an inkjet printhead using the nozzle plate, wherein an anti-wetting material is formed at a recess of the nozzle of the nozzle plate to form an anti-wetting layer, such that the anti-wetting layer at the recess will not be wiped by the wiper used for cleaning. However, the residual solution at the recess of the nozzle cannot be wiped by the wiper, and jams the nozzle after drying.

U.S. Pat. No. 6,484,399 discloses an inkjet printhead and a fabricating method thereof, wherein after an anti-wetting layer is formed on a surface of the nozzle plate, a wettable layer is formed on the periphery of the nozzle of the nozzle plate surrounding the nozzle through a photolithography technique to separate currents of ink of different colors, thereby preventing inks of different colors from mixing with one another. However, the inner edge of the nozzle near to the nozzle plate on the anti-wetting layer is easily wiped by the wiper and gets damaged, causing a deflection in direction of jetting the liquid drops.

As current digital jet-printing technology is being continuously developed, industrial digital jet-printing technology has a development trend. Therefore, as for jet-printing requirements of industrial solution with multiple applications, the problems of how to enhance the surface wear resistance of the nozzle plate and overcome jamming at the nozzle of the nozzle plate have become increasingly important.

SUMMARY OF THE INVENTION

Accordingly, one object of the present invention is to provide a nozzle plate for a droplet generator to enhance the surface wear resistance thereof.

Another object of the present invention is to provide a nozzle plate to reduce the probability of jamming at a nozzle of the nozzle plate.

A further object of the present invention is to provide a nozzle plate to reduce the probability of ink mixture on a surface of an droplet generator.

In Accordance with the aforementioned and other objects of the present invention, a nozzle plate suitable for an droplet generator is provided. The nozzle plate comprises a nozzle layer and at least one filler. The nozzle layer comprises a nozzle and at least one trench, wherein the nozzle passes through the nozzle layer, and the trench formed apart from the nozzle is located on a surface of the nozzle layer around the nozzle. The filler is filled in the trench and a wetting angle of a surface of the filler is different from a wetting angle of the surface of the nozzle layer. Since the ink jet-printed by the nozzle plate includes solution containing a solvent base, a water base, and so on, a wetting angle of a surface of a local area on the periphery of the nozzle of the nozzle layer may be adjusted through the aforementioned filler in the present invention.

According to an embodiment of the present invention, the trench may comprise a ring shaped trench, a continuous trench, or a discontinuous trench.

According to an embodiment of the present invention, when the nozzle layer may have a plurality of ring shaped trenches, these trenches may concentrically encircle the nozzle.

According to an embodiment of the present invention, when the nozzle layer may have a plurality of trenches, these trenches may include at least one ring shaped trench and at least one radial trench, wherein the ring shaped trench and the radial trench are intercrossed with each other.

According to an embodiment of the present invention, the material of the nozzle layer may be a wettable material, and the material of the filler may be an anti-wetting material. In addition, the wettable material may include nickel, silicon, or a material containing soap bases. Furthermore, the anti-wetting material may include carbon tetrafluoride.

According to an embodiment of the invention, the material of the nozzle layer may be an anti-wetting material, and the material of the filler may be a wettable material. In addition, the anti-wetting material may include polyimide, and the wettable material may include nickel or a material containing soap bases.

Based on the above, in the present invention, the trench is formed in the periphery of the nozzle in the nozzle layer of the nozzle plate, and then a filler is filled into the trench. After a plurality of fillers are filled into the trenches respectively, an ink-concentrated area or a solution-concentrated area is formed on the surface of the periphery of the nozzle in the nozzle layer, so as to resist residual ink or solution from flowing to other areas of the surface of the nozzle layer.

In order to the make aforementioned and other objects, features and advantages of the present invention comprehensible, preferred embodiments accompanied with FIGs. are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
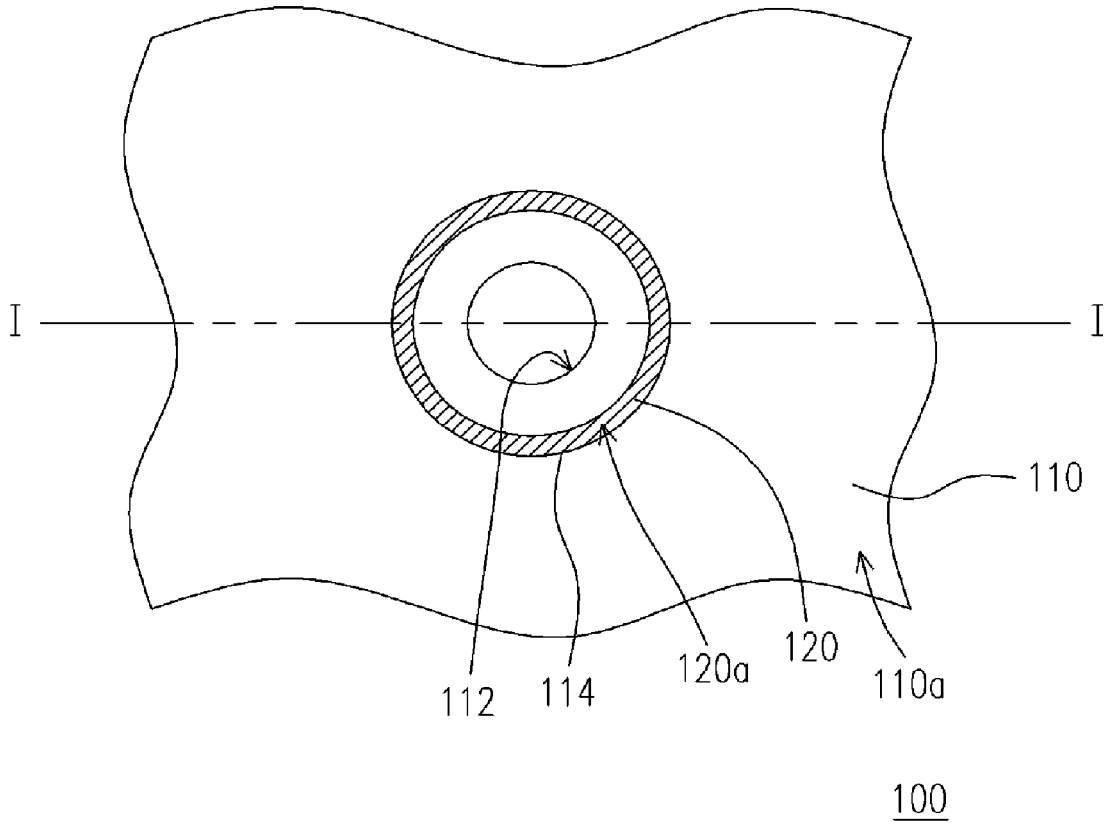
FIG. 1A is a top view of a nozzle plate according to a first embodiment of the present invention.
Figure 1B:
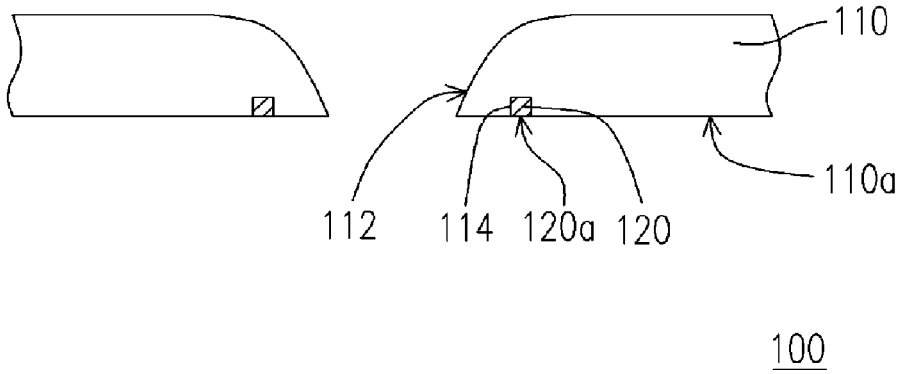
FIG. 1B is a sectional view of Line I-I in FIG. 1A.

FIG. 1A is a top view of a nozzle plate according to a first embodiment of the present invention, and FIG. 1B is a sectional view of Line I-I in FIG. 1A. Referring to FIGS. 1A and 1B, a nozzle plate 100 of the first embodiment is suitable for an droplet generator like an inkjet printhead or a nebulizer. The nozzle plate 100 comprises a nozzle layer 110. The nozzle layer 110 has a nozzle 112 passing through the nozzle layer 110, such that the droplet generator employing the nozzle plate 100 may jet ink drops or liquid drops via the nozzle 112.

In order to prevent residual ink or solution on a surface 110*a* near the nozzle 112 in the nozzle layer 110 from randomly flowing to other areas of the surface 110*a* of the nozzle layer 110, the nozzle layer 110 further comprises a trench 114 formed apart from the nozzle 112, wherein the trench 114 is located on the surface 110*a* of the nozzle layer 110 around the nozzle 112. Additionally, the nozzle plate 100 further comprises a filler 120 which is filled in the trench 114, wherein a wetting angle of a surface 120*a* of the filler 120 is different from a wetting angle of the surface 110*a* of the nozzle layer 110.

In the first embodiment, when the material of the nozzle layer 110 is a wettable material, such as nickel, silicon, or a material containing soap bases, and the material of the filler 120 is an anti-wetting material, such as carbon tetrafluoride, the wetting angle of the surface 120*a* of the filler 120 is larger than that of the surface 110*a* of the nozzle layer 110. On the contrary, when the material of the nozzle layer 110 is an anti-wetting material, such as polyimide, and the material of the filler 120 is a wettable material, such as nickel or a material containing soap bases, the wetting angle of the surface 120*a* of the filler 120 is smaller than that of the surface 110*a* of the nozzle layer 110.

Regardless of material, the material may both form an ink-concentrated area or a solution-concentrated area on the surface 110*a* around the nozzle 112 in the nozzle layer 110, such that the residual ink or solution on the surface 110*a* near to the nozzle 112 in the nozzle layer 110 may not randomly flow to other areas of the surface 110*a* of the nozzle layer 110, thereby reducing the probability of ink mixture on the surface of the droplet generator.

Two methods of fabricating the nozzle plate according to the first embodiment will be illustrated accompanied with figures below, wherein the first method is to apply an additive process, while the second method is to apply a subtractive process.

Figure 2A:
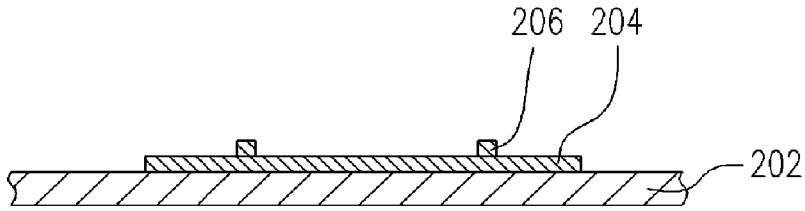
FIGS. 2A-2D show a method of fabricating the nozzle plate of the first embodiment of the present invention.

FIGS. 2A-2D show the first method of fabricating the nozzle plate. Referring to FIG. 2A, a conductive carrier plate 202 is first provided and a first insulating pattern 204 and a second insulating pattern 206 are formed thereon, wherein the first insulating pattern 204 is disposed on the conductive carrier plate 202, while the second insulating pattern 206 is disposed on the first insulating pattern 204.

Figure 2B:
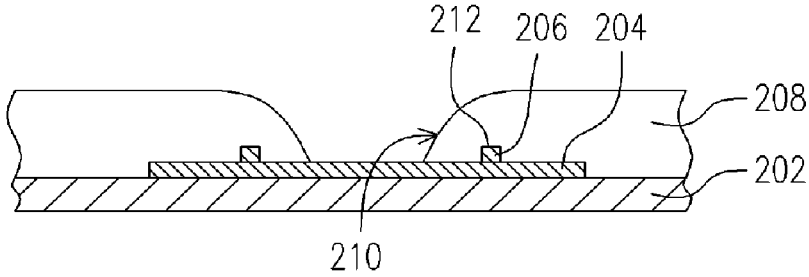

Referring to FIG. 2B, a nozzle layer 208, comprised of, for example, nickel, is then formed on the conductive carrier plate 202 by means of electroforming, while a nozzle 210 and a trench 212 are formed on the nozzle layer 208 through the first insulating pattern 204 and the second insulating pattern 206. Furthermore, the depth and profile of the trench 212 may be adjusted by changing thickness and profile of the second insulating pattern 206.

Figure 2C:
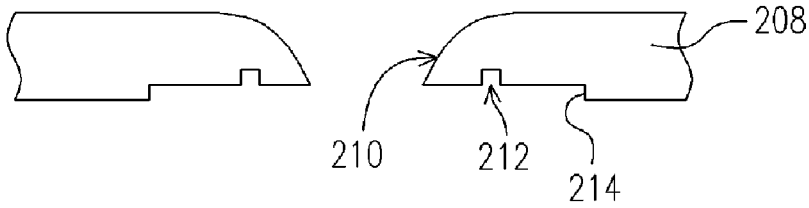

Referring to FIG. 2C, after the nozzle layer 208 is formed, the conductive carrier plate 202, the first insulating pattern 204, and the second insulating pattern 206 are removed to expose the trench 212 of the nozzle layer 208. It should be noted that the nozzle layer 208 may be formed using the electroforming process in order to facilitate the formation of the nozzle 210 directly in the nozzle layer 208, so that after the first insulating pattern 204 is removed, a recess 214 covering the nozzle 210 and the trench 212 is formed on the nozzle layer 208, wherein the trench 212 is located at the bottom of the recess 214.

Figure 2D:
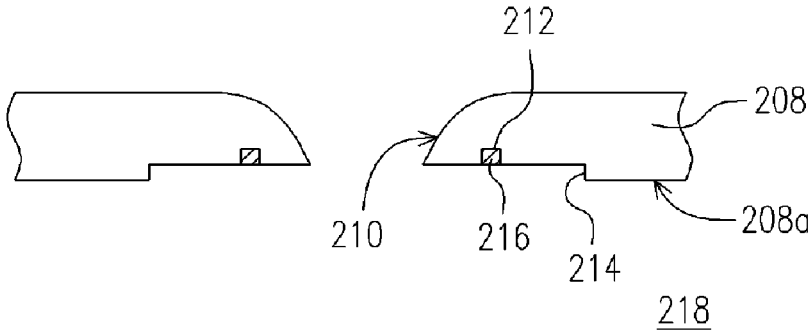

Referring to FIG. 2D, after the trench 212 is exposed, a filler 216 is filled in the trench 212. Thus, the fabrication of the nozzle plate 218 is completed. First, a filling material is spin coated on the surface of the nozzle layer 208 such that the filling material fills into the trench 212. Alternatively, the filling material may be coated using other known methods such as spraying, evaporation, dipping, and so on. Thereafter, portions of the filling material formed outside the trench 212 are removed by using of a plasma, and the filling material within the trench 212 serves as the filler 216 in the trench 212. Furthermore, the filler 216 may also be formed within the trench 212 by using a called drop on demand.

Figure 3A:
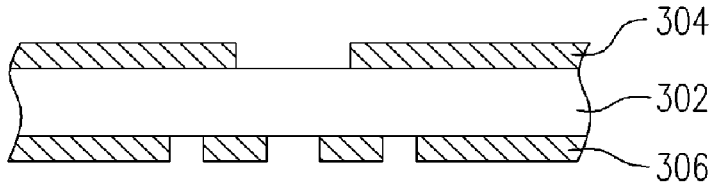
FIGS. 3A-3D show another method of fabricating the nozzle plate of the first embodiment of the present invention.
Figure 3B:
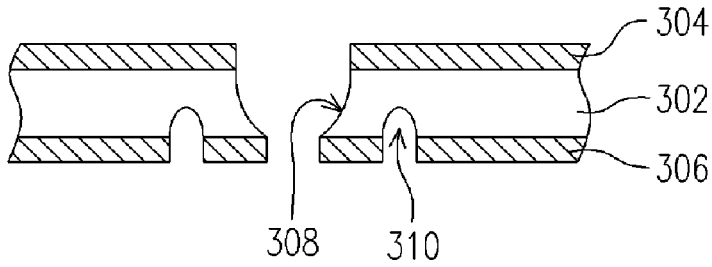
Figure 3C:
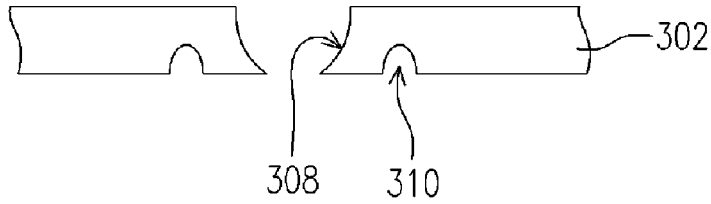
Figure 3D:
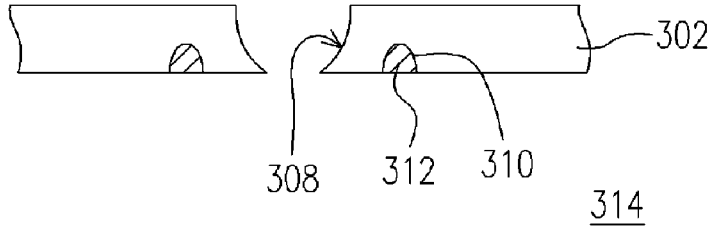

FIGS. 3A-3D show the second method of fabricating the nozzle plate in the first embodiment. Referring to FIG. 3A, a nozzle layer 302 is provided, and two mask patterns 304 and 306, partially exposing both sides of the nozzle layer 302, are formed on both sides of the nozzle layer 302, respectively, for example, by means of photolithography process. Referring to FIG. 3B, exposed portions of the nozzle layer 302 in FIG. 3A are removed by means of etching to form a nozzle 308 and a trench 310 on the nozzle layer 302. Furthermore, the profile and depth of the trench 310 is defined by the lower mask pattern 306 and controlling an etching rate. Referring to FIG. 3C, after the nozzle 308 and the trench 310 are formed on the nozzle layer 302, the two mask patterns 304 and 306 are then removed. Referring to FIG. 3D, after the two mask patterns 304 and 306 are removed, a filler 312 is then filled in the trench 310 to complete the fabrication of the nozzle plate 314. The method of filling the filler 312 in the trench 310 has been disclosed above, which is similar to that of filling the filler 216 in the trench 212 in FIG. 2D, and therefore it is described repeatedly.

It should be noted that in the first embodiment, only a single ring shaped continuous trench is formed on the nozzle layer of the nozzle plate, however trenches of different shapes and arrangements thereof, and number of trenches may also be used to achieve the purpose of the present invention, which is also construed to be within the scope of the present invention.

Figure 4A:
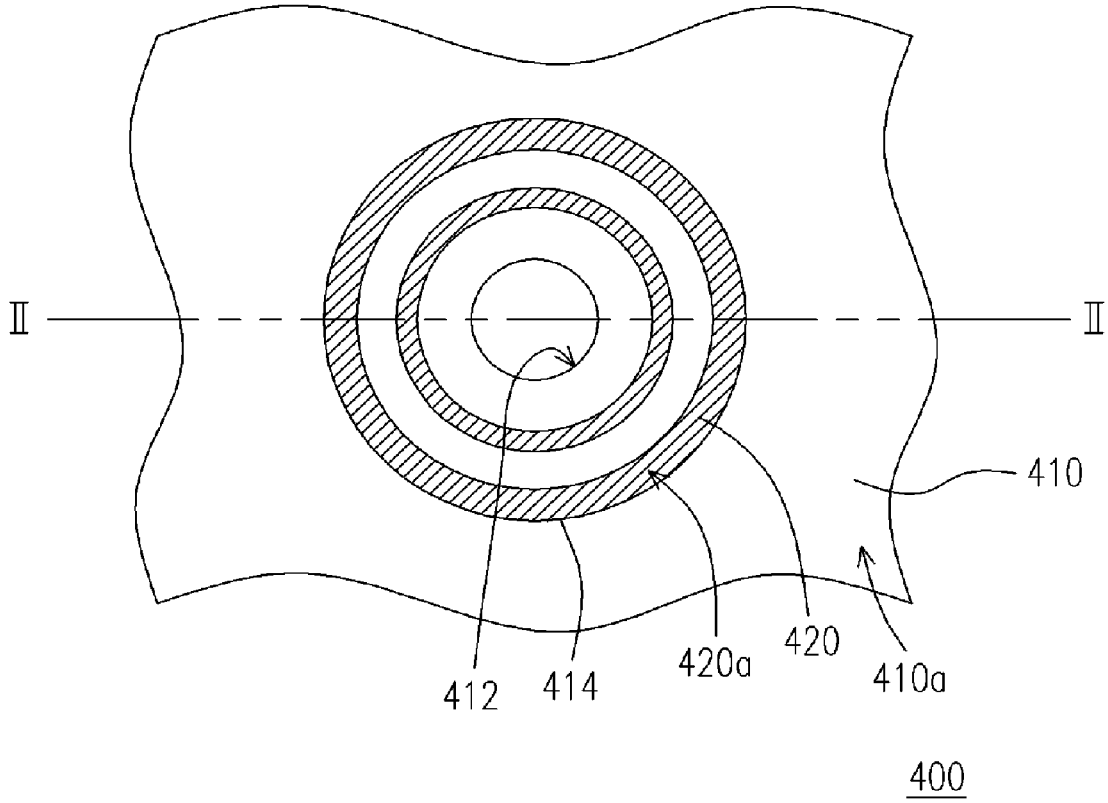
FIG. 4A is a top view of a nozzle plate according to a second embodiment of the present invention.
Figure 4B:
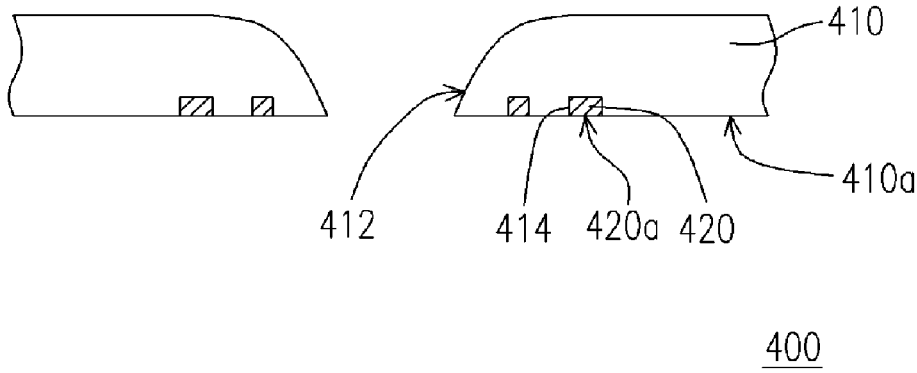
FIG. 4B is a sectional view of Line II-II in FIG. 4A.

FIG. 4A is a top view of a nozzle plate according to a second embodiment of the present invention, and FIG. 4B is a sectional view of Line II-II shown in FIG. 4A. Referring to FIGS. 4A and 4B, the nozzle plate 400 according to the second embodiment has a nozzle layer 410. The nozzle layer 410 has a nozzle 412 passing therethrough. Compared to the first embodiment described above which employs the single ring shaped continuous trench 214 of the nozzle layer 210, two ring shaped continuous trenches 414 are formed on the nozzle layer 410 apart from the nozzle 412, wherein the trenches 414 are formed on a surface 410*a* of the nozzle layer 410 and concentrically encircle the nozzle 412. In addition, in order to partially adjust wetness of the surface 410*a* of the periphery of the nozzle 412 in the nozzle layer 410, a plurality of fillers 420 are respectively filled in the trenches 414, wherein a wetting angle of surfaces 420*a* of these fillers 420 is different from a wetting angle of the surface 410*a* of the nozzle layer 410.

Figure 5:
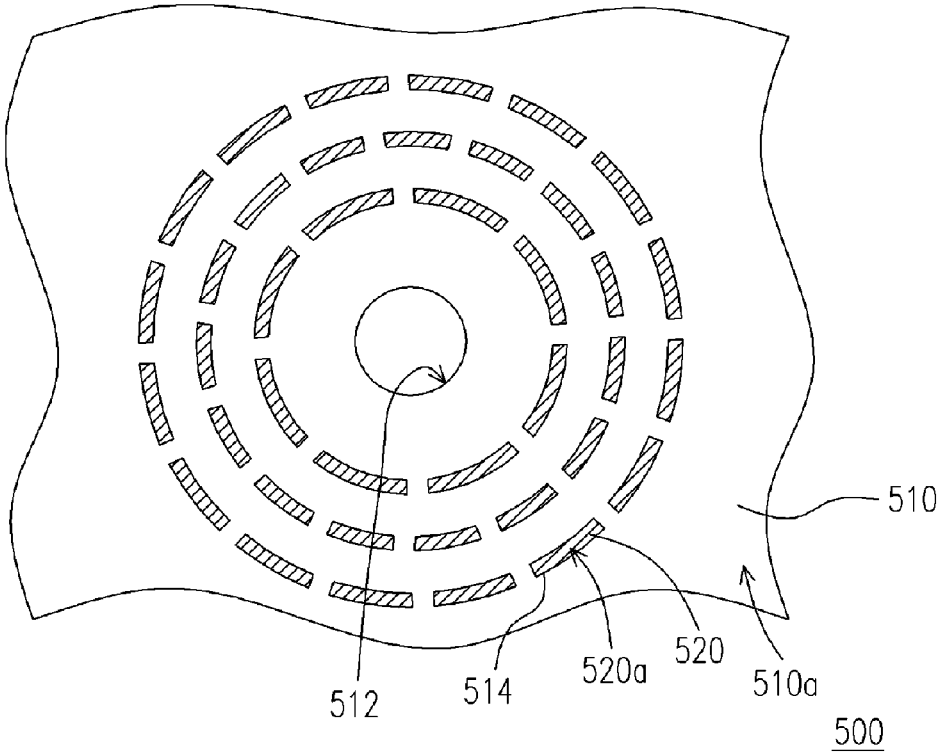
FIG. 5 is a top view of a nozzle plate according to a third embodiment of the present invention.

FIG. 5 is a top view of a nozzle plate according to a third embodiment of the present invention. Referring to FIG. 5, the nozzle plate 500 of the third embodiment comprises a nozzle layer 510. The nozzle layer 510 has a nozzle 512 passing therethrough. Compared to the second embodiment described with reference to FIG. 4A, three ring shaped discontinuous trenches 514 are formed on the nozzle layer 510 apart from the nozzle 512, wherein the trenches 514 are located on a surface 510*a* of the nozzle layer 510 and concentrically encircle the nozzle 512. In addition, in order to partially adjust wetness of the surface 510*a* of the periphery of the nozzle 512 of the nozzle layer 510, a plurality of fillers 520 are respectively filled in these ring shaped discontinuous trenches 514, wherein a wetting angle of surfaces 520*a* of the fillers 520 is different from a wetting angle of the surface 510*a* of the nozzle layer 510.

Figure 6:
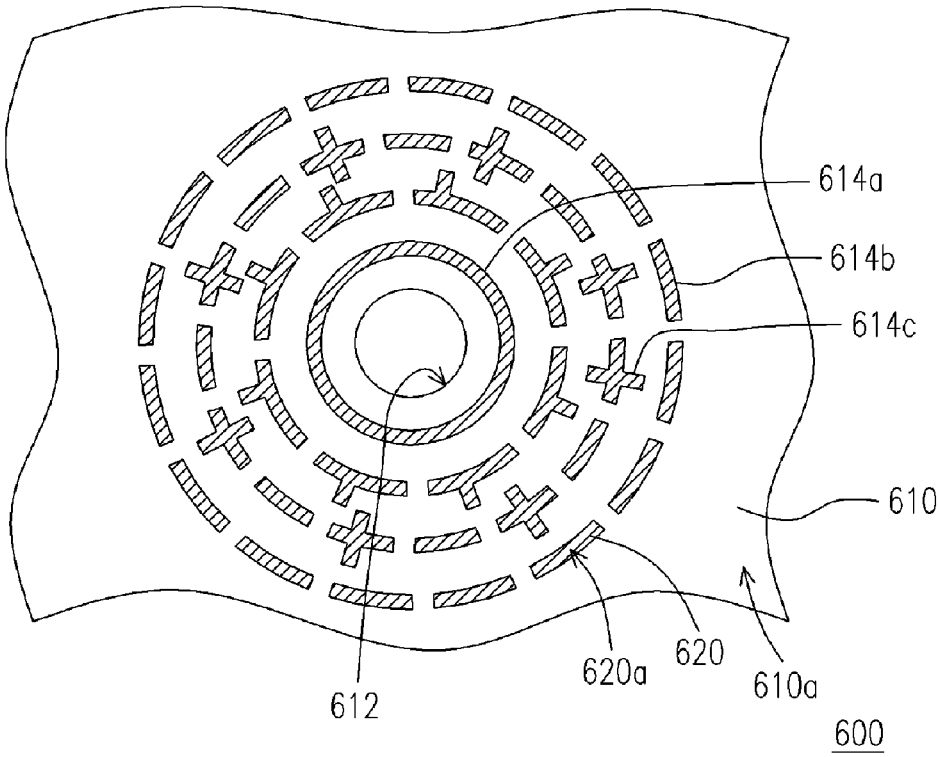
FIG. 6 is a top view of a nozzle plate according to a fourth embodiment of the present invention.

FIG. 6 is a top view of a nozzle plate of the fourth embodiment of the present invention. Referring to FIG. 6, the nozzle plate 600 in the fourth embodiment comprises a nozzle layer 610. The nozzle layer 610 has a nozzle 612 passing therethrough. Compared to the second embodiment described with reference to FIG. 4A, a ring shaped continuous trench 614*a* and a plurality of ring shaped discontinuous trenches 614*b* respectively on the nozzle layer 610 apart from the nozzle 612, wherein the trenches 614*a* and 614*b* are located on a surface 610*a* of the nozzle layer 610 and concentrically encircle the nozzle 612. The nozzle layer 610 further has a plurality of radial trenches 614*c* formed apart from the nozzle 612, wherein the trenches 614*c* are located on the surface 610*a* of the nozzle layer 610 and intercrossed with these ring shaped discontinuous trenches 614*b*. In addition, in order to partially adjust wetness of the surface 610*a* of the periphery of the nozzle 612 in the nozzle layer 610, a plurality of fillers 620 are respectively filled in these ring discontinuous trenches 614, wherein a wetting angle of surfaces 620*a* of these fillers 620 is different from a wetting angle of the surface 610*a* of the nozzle layer 610.

According to an aspect of the present invention, one or more trenches, including ring shaped continuous trenches, ring shaped discontinuous trenches or radial trenches may be formed on the nozzle layer to surround the nozzle in order to resist the residual ink or solution from flowing to other areas on the surface of the nozzle layer.

Figure 7A:
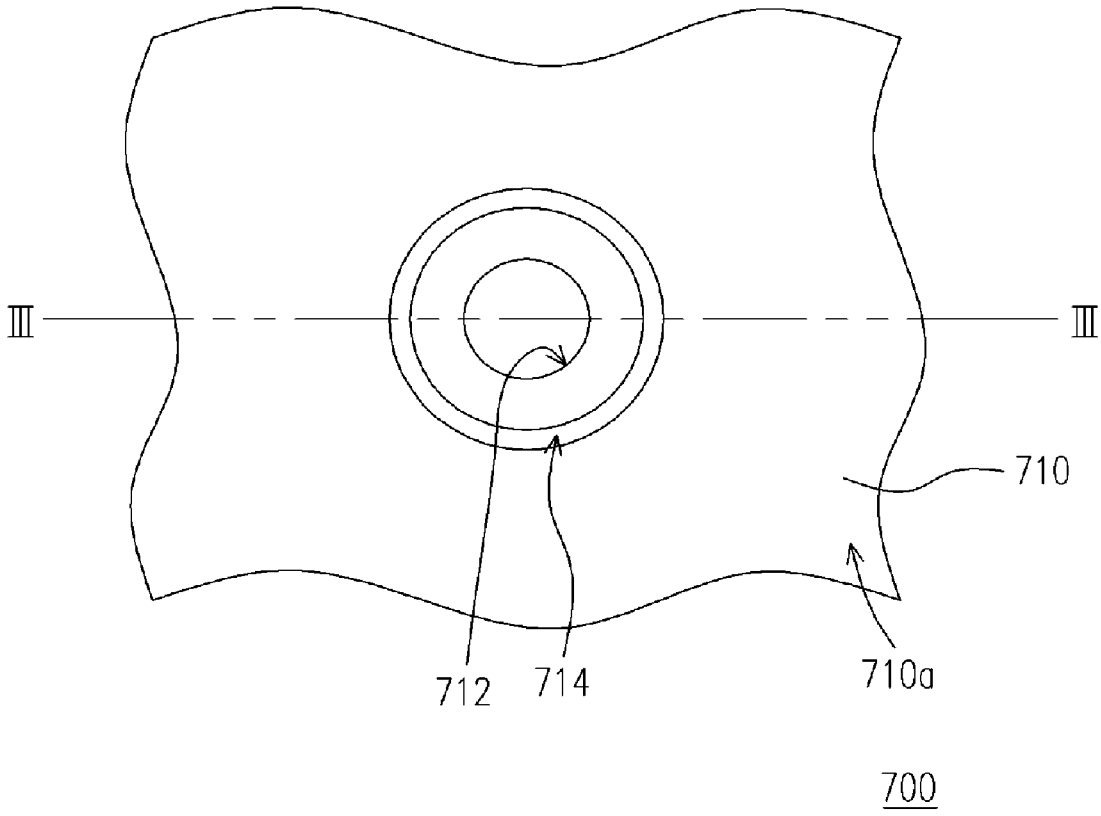
FIG. 7A is a top view of a nozzle plate according to a fifth embodiment of the present invention.
Figure 7B:
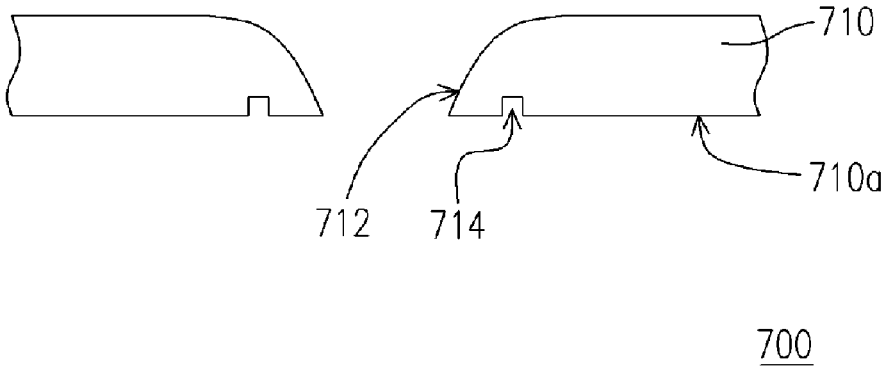
FIG. 7B is a sectional view of Line III-III in FIG. 7A.

FIG. 7A is a top view of a nozzle plate according to a fifth embodiment of the present invention, and FIG. 7B is a sectional view of Line III-III in FIG. 7A. Referring to FIGS. 7A and 7B, the nozzle plate 700 according to the fifth embodiment has a nozzle layer 710. The nozzle layer 710 has a nozzle 712 passing therethrough. Compared to the first embodiment described above which employs the filler 120 filled in the trench 114 in FIGS. 1A and 1B, the fifth embodiment omits the use of the filler 120. Since a trench 714, on a surface 710*a* of the nozzle layer 710 and apart from the nozzle 712, causes the discontinuity on the surface 710*a*, and therefore effects the wettable property of the surface 710*a*. Accordingly, the fifth embodiment omits the filler and consequently reduces the cost.

In view of the above, in the present invention, the trench is formed on the periphery of the nozzle in the nozzle layer of the nozzle plate with or without a filler filled therein to form an ink-concentrated area or a solution-concentrated area on the surface of the periphery of the nozzle in the nozzle layer to resist the residual ink or solution from flowing to other areas on the surface of the nozzle layer, thereby reducing the probability of mixing ink on the surface of the droplet generator, for example, reducing the probability of ink color mixing on the surface of a color droplet generator.

When the fillers are utilized, since side edges of the aforementioned fillers filled in the nozzle layer are not exposed, after the surface of the nozzle layer is wiped by the wiper used for cleaning, the fillers are not easily wiped by the wiper, thereby enhancing the surface wear resistance of the nozzle plate. In addition, since the inner wall of the nozzle of the nozzle layer has a specific property, for example, a wettable property or an anti-wetting property, the ink or solution passing through the nozzle is not easily retained or dried up in the nozzle. Thus, the probability of jamming at the nozzle may be substantially reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A nozzle plate for a droplet generator, comprising: a nozzle layer, having a first surface, a second surface, a nozzle and a trench, wherein the nozzle passes through the nozzle layer, the trench is separated from the nozzle by the first surface which surrounds the nozzle and is located in the nozzle layer, the first surface and the second surface which surrounds the trench are coplanar, and a bottom of the trench is deeper inside the nozzle layer than the first surface and the second surface; and a filler, filled and remaining in the trench, wherein a wetting angle of a surface of the filler is different from a wetting angle of the first surface and the second surface of the nozzle layer, and the depth of the filler is substantially equal to the depth of the trench; and wherein the nozzle layer has a recess covering the nozzle and the trench, and the trench is located at the bottom of the recess.

2. The nozzle plate as claimed in claim 1, wherein the trench comprises a ring shaped trench.

3. The nozzle plate as claimed in claim 2, wherein the trench comprises a continuous trench.

4. The nozzle plate as claimed in claim 2, wherein the trench comprises a discontinuous trench.

5. The nozzle plate as claimed in claim 1, wherein the material of the nozzle layer comprises a wettable material, and a material of the filler comprises an anti-wetting material.

6. The nozzle plate as claimed in claim 5, wherein the wettable material includes nickel.

7. The nozzle plate as claimed in claim 5, wherein the anti-wetting material includes carbon tetrafluoride.

8. The nozzle plate as claimed in claim 1, wherein the material of the nozzle layer comprises an anti-wetting material, and the material of the filler comprises a wettable material.

9. The nozzle plate as claimed in claim 8, wherein the anti-wetting material includes polyimide.

10. The nozzle plate as claimed in claim 8, wherein the wettable material includes nickel or a material containing soap bases.

11. A nozzle plate for a droplet generator, comprising: a nozzle layer, having a first surface, a second surface, a nozzle and a plurality of trenches, wherein the nozzle passes through the nozzle layer, the trenches are separated from the nozzle by the first surface which surrounds the nozzle and are located in the nozzle layer, the first surface and the second surface which surrounds the trenches are coplanar, and bottoms of the trenches are deeper inside the nozzle layer than the first surface and the second surface; and a plurality of fillers, filled and remaining in the trenches respectively, wherein a wetting angle of surfaces of the fillers is different from a wetting angle of the first surface and the second surface of the nozzle layer, and the depth of each of the fillers is substantially equal to the depth of the corresponding trench; and wherein the nozzle layer has a recess covering the nozzle and the trenches, and the trenches are located at the bottom of the recess.

12. The nozzle plate as claimed in claim 11, wherein one of the trenches comprises a ring shaped trench.

13. The nozzle plate as claimed in claim 12, wherein one of the trenches comprises a continuous trench.

14. The nozzle plate as claimed in claim 12, wherein one of the trenches comprises a discontinuous trench.

15. The nozzle plate as claimed in claim 12, wherein the trenches concentrically encircle the nozzle.

16. The nozzle plate as claimed in claim 11, wherein the trenches include at least one ring shaped trench and at least one radial trench, wherein the radial trench and the ring trench are intercrossed with each other.

17. The nozzle plate as claimed in claim 11, wherein the material of the nozzle layer comprises a wettable material, and a material of the fillers comprises an anti-wetting material.

18. The nozzle plate as claimed in claim 17, wherein the wettable material includes nickel.

19. The nozzle plate as claimed in claim 17, wherein the anti-wetting material includes carbon tetrafluoride.

20. The nozzle plate as claimed in claim 11, wherein the material of the nozzle layer comprises an anti-wetting material, and a material of the fillers comprises a wettable material.

21. The nozzle plate as claimed in claim 20, wherein the anti-wetting material includes polyimide.

22. The nozzle plate as claimed in claim 20, wherein the wettable material includes nickel or a material containing soap bases.

23. A nozzle plate for a droplet generator, comprising: a nozzle layer having a nozzle and a trench, wherein the nozzle pass through the nozzle layer, and the trench apart from the nozzle is located on a surface of the nozzle layer around the nozzle; and wherein the nozzle layer has a recess covering the nozzle and the trench, and the trench is located at the bottom of the recess.

24. The nozzle plate as claimed in claim 23, wherein the trench comprises a ring shaped trench.

25. The nozzle plate as claimed in claim 23, wherein the trench comprises a continuous trench.

26. The nozzle plate as claimed in claim 23, wherein the trench comprises a discontinuous trench.

27. The nozzle plate as claimed in claim 5, wherein the wettable material includes silicon or a material containing soap bases.

28. The nozzle plate as claimed in claim 17, wherein the wettable material includes silicon or a material containing soap bases.

* * * * *